US005970525A

United States Patent [19]

Gallinot et al.

[11] Patent Number: 5,970,525

[45] Date of Patent: Oct. 26, 1999

[54] LEG GUARD APPARATUS

[76] Inventors: Joan Gallinot, R.R. #2, Box 2392, Waymart, Pa. 18742; Michael Naholnik, 17-13 New Hope St., Norristown, Pa. 19401

[21] Appl. No.: 09/035,045

[22] Filed: Mar. 5, 1998

[51] Int. Cl.[6] ..... A41D 13/06

[52] U.S. Cl. ..... 2/242; 2/22; 2/23; 2/46

[58] Field of Search ..... 2/22, 23, 69, 46, 2/51, 242, 455; 602/23, 62, 63

[56] References Cited

U.S. PATENT DOCUMENTS

| | | | |
|---|---|---|---|
| 1,624,129 | 4/1927 | Barrett | 2/22 |
| 2,249,553 | 7/1941 | Cataffo | 2/22 |
| 2,717,387 | 9/1955 | McMahan | 2/22 |
| 3,153,864 | 10/1964 | Brewer | 2/22 |
| 4,497,070 | 2/1985 | Cho | 2/22 |
| 4,633,529 | 1/1987 | Litz | 2/22 |
| 4,665,562 | 5/1987 | Winer | 2/22 |
| 4,926,501 | 5/1990 | Goosen . | |
| 5,297,294 | 3/1994 | Washick . | |
| 5,613,250 | 3/1997 | Bell | 2/242 |
| 5,625,896 | 5/1997 | LaBarbera et al. . | |
| 5,806,092 | 9/1998 | Shikatani | 2/22 |

*Primary Examiner*—Gloria Hale
*Attorney, Agent, or Firm*—Henderson & Sturm

[57] ABSTRACT

A leg guard apparatus 10 for preventing mechanically propelled debris from impacting on a person's lower leg and/or being deposited on or in their footwear 100. The apparatus 10 comprises a cover member 20 fabricated from an elongated sheet 21 of protective material 22 and provided with a plurality of strap members 30 for snugly positioning the cover member 20 over the user's lower leg 100 and footwear 101.

1 Claim, 1 Drawing Sheet

LEG GUARD APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of leg protection devices in general, and in particular to a leg protector apparatus that covers both the user's leg and foot.

2. Description of Related Art

As can be seen by reference to the following U.S. Pat. Nos. 4,665,562; 4,926,501; 5,297,294; and 5,625,896, the prior art is replete with myriad and diverse leg protector devices that are strapped onto the user's leg to protect at least the front portion thereof.

While all of the aforementioned prior art constructions are more than adequate for the basic purpose and function for which they have been specifically designed, they are uniformly deficient with respect to their failure to provide a simple, efficient, and practical way to extend the scope of protection offered by a leg protector device not only to the user's lower leg, but also to the top of the user's foot and associated footwear.

As most homeowners and landscape workers are well aware, many yard and gardening tasks such as grass cutting, weed whacking, leaf blowing, or raking, and gardening result in dirt, twigs, leaves, grass cuttings, and other outdoor debris being deposited on the lower legs and feet of the person performing the tasks.

As a consequence of the foregoing situation, there has existed a longstanding need for a new and improved type of lightweight, low cost, lower leg and foot covering and protecting device and the provision of such a construction is a stated objective of the present invention.

BRIEF SUMMARY OF THE INVENTION

Briefly stated, the leg guard apparatus that forms the basis of the present invention comprises a protective cover unit, and strap assembly that forms a protective device extending from the vicinity of the user's knee to the vicinity of the toe of the user's footwear.

As will be explained in greater detail further on in the specification, the cover unit includes a cover member fabricated from an elongated sheet of protective material wherein the cover member has a leg portion and a foot portion conformable to the outer periphery of the user's lower leg and foot.

In addition, the strap assembly comprises a plurality of strap members for operatively connecting the cover member to the user's lower leg and foot. The plurality of strap members includes a pair of strap members attached to the foot portion of the cover member.

Given the fact that the leg guard apparatus of this invention is specifically designed to counteract the effects of mechanically propelled debris against the user's lower leg, the provision of the dual strap members on the foot portion of the cover member assumes particular importance in that one strap member is disposed adjacent the toe of the user's footwear and the other strap member is disposed adjacent the user's instep.

The toe strap member prevents debris from entering under the leading edge of the foot portion of the cover member and the user's footwear, and the instep strap member prevents the sides of the foot portion of the cover member from being pneumatically flared outwardly to allow debris to be deposited on or within the user's footwear.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
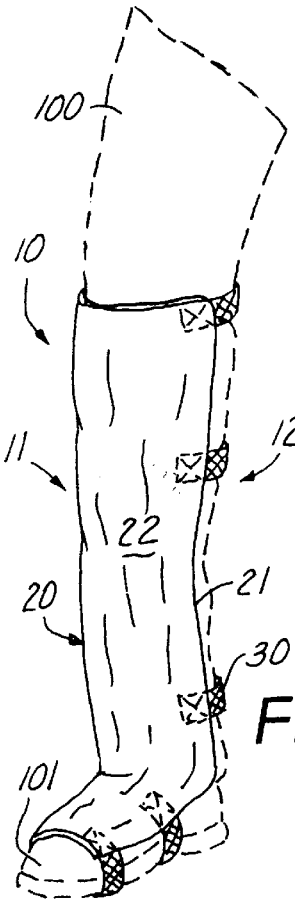
FIG. 1 is a front perspective view of the short version of the leg guard apparatus that forms the basis of the present invention.

As can be seen by reference to the drawings, and in particularly to FIG. 1, the leg guard apparatus that forms the basis of the present invention is designated generally by the reference number 10. The apparatus 10 comprises a protective cover unit 11 and a strap assembly 12. These structural components will now be described in seriatim fashion.

As shown in FIGS. 1 through 4, the protective cover unit 11 includes a cover member 20 fabricated from an elongated generally rectangular sheet 21 of protective material 22, such as rubber, foam rubber, heavy canvas, or the like. The protective material 22 will have either a degree of resiliency to provide cushioning to protect against propelled objects, such as stones, twigs, etc. and to provide an intermediate cushioned surface when the wearer kneels down, or a degree of rigidity to deflect or absorb the force of propelled objects before that force is transmitted to the user's person.

In either event, the protective material 22 must have sufficient flexibility so as to be deformable into a generally C-shaped configuration to substantially encircle and cover the front and sides of the user's lower leg 100, as well as the top and sides of the user's foot and footwear 101.

Figure 2:
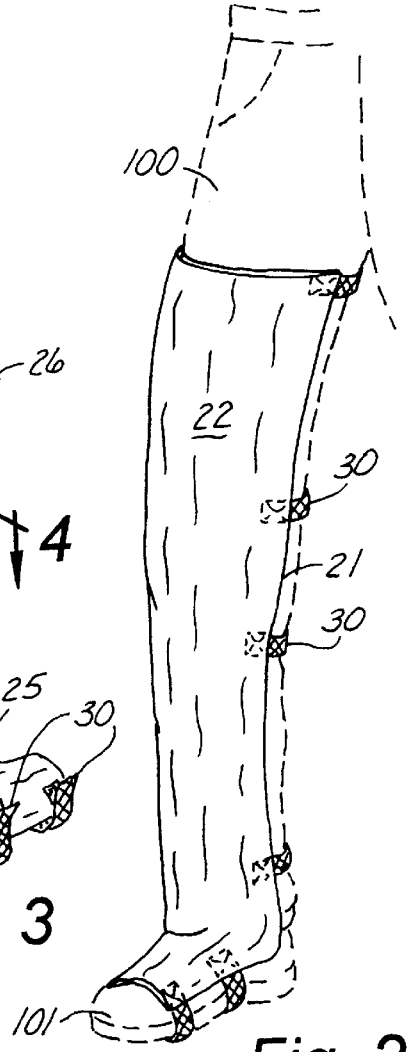
FIG. 2 is a front perspective view of the long version of the leg guard apparatus of this invention.

In the preferred embodiment of the invention illustrated in FIGS. 1 and 2, the length of the cover member 20 is chosen to extend from just above the user's knee to just behind the toe portion of the user's footwear. In the alternate version of the preferred embodiment, the length of the cover member 20 is chosen to extend from the user's mid-thigh to the toe portion of the footwear 101.

Figure 3:
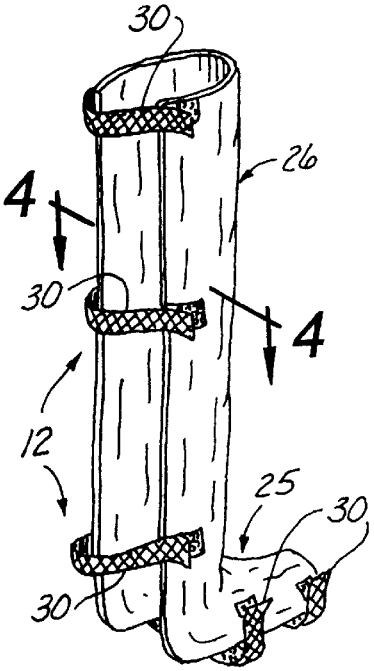
FIG. 3 is a rear perspective view of the short version of the apparatus.
Figure 5:
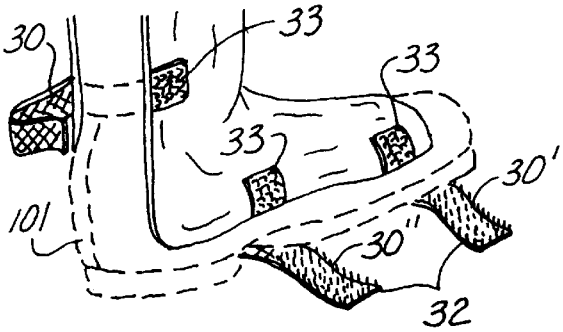
FIG. 5 is an isolated detail view of the foot/shoe covering portion of the apparatus.
Figure 4:
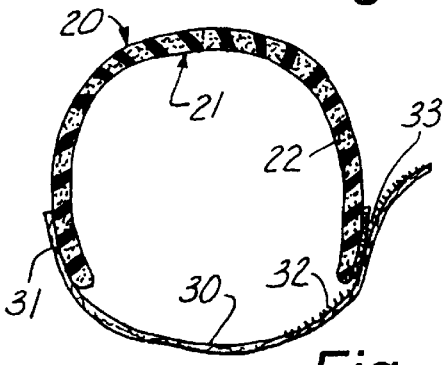
FIG. 4 is a cross sectional view taken through line 4—4 of FIG. 3.

Turning now to FIGS. 3 through 5, it can be seen that the strap assembly 12 comprises a plurality of strap members 30 secured on one end 31 to one side of the cover member 20 and provided on their other end with one portion 32 of a hook and loop fastener, which cooperates with the other portion 33 of the hook and loop fastener which is disposed on the other side of the cover member 20.

In the preferred embodiment of the invention illustrated in FIGS. 1 and 3, the foot portion 25 of the cover member 20 is provided with a pair of strap members 30 wherein one strap member 30' is disposed proximate to the user's toe and the other strap member 30" is disposed proximate to the user's instep.

This plural foot strap arrangement is deemed necessary given the high speed that debris particles can be propelled rearwardly towards the user by most mechanized lawn and garden implements. The toe strap 30' is considered to be the most critical of the two strap members 30 in that this strap member 30' is the first line of defense to prevent debris from being deposited on the upper surface of the user's footwear 101.

It should also be noted however that the instep strap member 30" also plays a crucial role in preventing the cover member 20 to be flared outwardly by pneumatic forces to allow debris to be deposited inside of the user's footwear 101.

As can also be seen by reference to FIGS. 1 and 3, the leg portion 26 of the cover member is provided with three straps. An upper strap is disposed at the top of the cover member 20 above the user's knee, a lower strap is disposed above the user's ankle and an intermediate strap is disposed beneath the user's knee. In the alternate version of the preferred embodiment depicted in FIG. 2, the cover member 20 is provided with an upper strap, a lower strap, and a pair of intermediate straps. The intermediate straps are disposed both above and below the user's knee.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A leg guard apparatus for preventing mechanically propelled debris from coming into contact with a person's lower leg and footwear wherein the apparatus consists of:

a protective cover member fabricated from a generally elongated sheet of protective material which extends from the toe portion of the user's footwear to a point at least adjacent the user's knee wherein the sheet of material includes a leg portion dimensioned to cover and partially encircle the front and sides of the user's lower leg and a foot portion dimensioned to cover and partially encircle the top and sides of the user's footwear; and a strap assembly for operatively attaching the cover member to the user's lower leg and foot wherein the strap assembly comprises a plurality of strap members; wherein, each of the plurality strap members have one end attached on one side of the protective cover member and the other end provided with a hook and loop fastener component, and the other side of the cover member is provided with a plurality of the other component of a hook and loop fastener, whereby the strap members can operatively engage the cover member to the lower leg and the user's footwear and the foot portion of the cover member is provided with a pair of strap members wherein one of the pair of strap members is disposed adjacent the toe of the user's footwear and the other of the pair of strap members is disposed adjacent the instep of the user's footwear and wherein the leg portion of the cover member is provided with strap members on both the upper and lower ends of the leg portion of the cover member.

* * * * *